US011840939B1

(12) United States Patent
Bhaskaran et al.

(10) Patent No.: US 11,840,939 B1
(45) Date of Patent: Dec. 12, 2023

(54) GAS TURBINE ENGINE WITH AN AIRFOIL

(71) Applicant: GENERAL ELECTRIC COMPANY, Schenectady, NY (US)

(72) Inventors: Rathakrishnan Bhaskaran, Niskayuna, NY (US); Thomas W. Vandeputte, Scotia, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/835,091

(22) Filed: Jun. 8, 2022

(51) Int. Cl.

| | |
|---|---|
| ***F01D 5/14*** | (2006.01) |
| ***F01D 5/18*** | (2006.01) |
| *F04D 29/32* | (2006.01) |
| *F04D 29/54* | (2006.01) |
| *F04D 29/38* | (2006.01) |

(52) U.S. Cl.
CPC ..... *F01D 5/141* (2013.01); *F01D 5/189* (2013.01); *F04D 29/324* (2013.01); *F04D 29/384* (2013.01); *F04D 29/544* (2013.01); *F05D 2220/323* (2013.01); *F05D 2240/303* (2013.01); *F05D 2240/304* (2013.01); *F05D 2260/202* (2013.01)

(58) Field of Classification Search
CPC ..... F01D 5/141; F04D 29/324; F04D 29/384; F04D 29/544; F05D 2240/304; F05D 2240/122
See application file for complete search history.

(56) References Cited

U.S. PATENT DOCUMENTS

| | | | | |
|---|---|---|---|---|
| 1,968,918 | A * | 8/1934 | Toth | B64C 11/16 416/237 |
| 2,406,499 | A * | 8/1946 | Jandasek | F16H 61/56 60/330 |
| 2,754,916 | A | 7/1956 | Woolf | |
| 3,044,745 | A | 7/1962 | Stark | |
| 3,697,193 | A * | 10/1972 | Phillips | B64C 11/18 416/243 |
| 3,993,414 | A * | 11/1976 | Meauze | F04D 29/324 415/181 |
| 4,451,208 | A * | 5/1984 | Kolecki | B64C 11/18 29/889.6 |
| 4,560,358 | A * | 12/1985 | Adler | A63H 33/18 473/589 |
| 5,209,644 | A * | 5/1993 | Dorman | F01D 5/145 416/235 |
| 5,676,522 | A * | 10/1997 | Pommel | F01D 9/041 415/181 |
| 5,759,352 | A * | 6/1998 | Lau | D21F 1/38 226/97.1 |
| 6,358,013 | B1 | 3/2002 | Rose et al. | |
| 6,638,021 | B2 * | 10/2003 | Olhofer | F01D 5/141 416/243 |

(Continued)

*Primary Examiner* — Woody A Lee, Jr.
*Assistant Examiner* — Behnoush Haghighian
(74) *Attorney, Agent, or Firm* — McGarry Bair PC

(57) ABSTRACT

A turbine engine includes a compressor section, a combustion section, and a turbine section. Fuel combusted in the combustion section drive stages of airfoils in the turbine section to drive the compressor section. The airfoils can include a geometry near or at the trailing edge with a linear portion provided between the pressure side and a first curved portion, to reduce shock generated in the wake of the airfoils.

20 Claims, 9 Drawing Sheets

(56) References Cited

U.S. PATENT DOCUMENTS 6,666,654 B2 * 12/2003 Olhofer ..... F01D 5/141 416/228
6,799,948 B2 * 10/2004 Ito ..... F01D 5/143 416/223 A
7,147,426 B2 * 12/2006 Leblanc ..... F04D 29/526 415/181
7,597,544 B2 10/2009 Hasenjager et al.
7,665,967 B1 * 2/2010 Parker ..... F04D 25/088 416/223 R
8,579,594 B2 11/2013 Fuglsang et al.
9,371,734 B2 * 6/2016 Hamabe ..... F01D 5/145
10,024,167 B2 * 7/2018 Hamabe ..... F01D 5/14
10,370,973 B2 * 8/2019 Heikurinen ..... F04D 29/324
10,443,607 B2 * 10/2019 Brown ..... F04D 29/324
10,677,066 B2 * 6/2020 Lewis ..... F01D 5/20
11,078,799 B2 8/2021 Karakasis et al.
11,111,930 B2 * 9/2021 Norwood ..... F04D 25/088
2002/0085918 A1 * 7/2002 Olhofer ..... F01D 5/141 416/243
2002/0094276 A1 * 7/2002 Ito ..... F01D 5/18 416/243
2003/0170125 A1 * 9/2003 Olhofer ..... F01D 5/141 415/914
2005/0079060 A1 * 4/2005 MacManus ..... F01D 9/041 416/235
2013/0224034 A1 * 8/2013 Sakamoto ..... F01D 5/141 416/225
2014/0112795 A1 * 4/2014 Hamabe ..... F01D 5/141 416/223 R
2015/0104296 A1 * 4/2015 Yokoyama ..... F02B 37/22 415/146
2015/0233253 A1 * 8/2015 Hamabe ..... F01D 5/147 416/223 A
2016/0348692 A1 * 12/2016 Heikurinen ..... F04D 19/022
2017/0145828 A1 * 5/2017 Lewis ..... F01D 11/08
2017/0292528 A1 * 10/2017 Brown ..... F01D 5/141
2021/0215050 A1 7/2021 Vandeputte
2023/0025455 A1 * 1/2023 Maar ..... F01D 5/141

* cited by examiner

GAS TURBINE ENGINE WITH AN AIRFOIL

TECHNICAL FIELD

The present subject matter relates generally to a gas turbine engine, and more specifically to a structure for an airfoil in the gas turbine engine for reducing shock and related losses near a trailing edge of the airfoil, and during supersonic flow conditions.

BACKGROUND

A gas turbine engine typically includes a fan and a turbomachine. The turbomachine generally includes an inlet, one or more compressors, a combustor, and at least one turbine. The compressor compresses air which is channeled to the combustor where it is mixed with fuel, and ignited for generating hot combustion gases to drive the turbine. The turbine and compressor utilize a set of airfoils to extract energy from the combustion gases in the turbine and to compress the air at the compressor.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
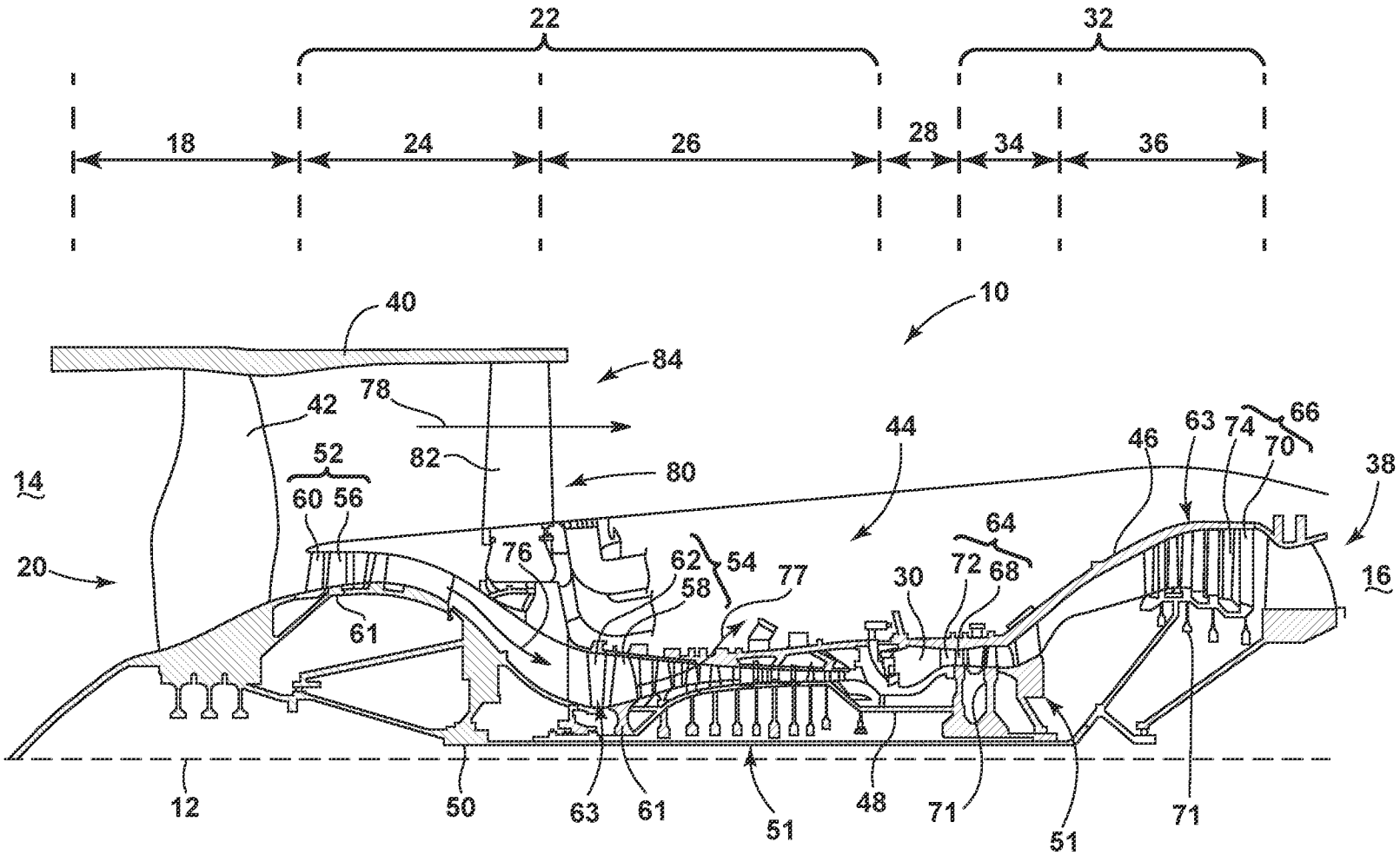
FIG. 1 is a schematic cross-sectional view of a gas turbine engine, in accordance with an exemplary embodiment of the present disclosure.

Aspects of the disclosure herein are directed to a trailing edge structure for an airfoil utilized within a gas turbine engine, and more specifically, to a trailing edge geometry for reducing wake and shock, such as during supersonic flow speeds. For purposes of illustration, the present disclosure will be described with respect to a turbine blade of a turbine for an aircraft gas turbine engine. It will be understood, however, that aspects of the disclosure herein are not so limited and may have general applicability within an engine, including compressors and turbines, as well as in non-aircraft applications, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", "third", and "fourth" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow.

The term "fluid" may be a gas or a liquid, or multi-phase. The term "fluid communication" bs that a fluid is capable of making the connection between the areas specified.

The term "virtual" as used herein relates to a feature or element that is not physically existing. "Virtual" features or elements are those used to define related physical elements or the structure of the physical elements related to those virtual features or elements.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "generally" and "substantially", are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

In certain exemplary embodiments of the present disclosure, a gas turbine engine defining a centerline and a circumferential direction is provided. The gas turbine engine may generally include a turbomachine and a rotor assembly. The rotor assembly may be driven by the turbomachine. The turbomachine, the rotor assembly, or both may define a substantially annular flow path relative to the centerline of the gas turbine engine. The gas turbine engine includes an airfoil, by way of non-limiting example a turbine blade positioned within the flow path, with a trailing edge geometry to reduce shock. The airfoil described herein can be a plurality of airfoils provided circumferentially about the centerline or be partially provided about a portion of the centerline.

Reference will now be made in detail to an airfoil, and in particular the trailing edge geometry for an airfoil, one or more examples of which are illustrated in the accompanying drawings. The detailed description uses numerical and letter designations to refer to features in the drawings. The inventors' practice has proceeded in the manner of designing an airfoil, modifying the airfoil with the trailing edge geometry to meet reduce shock and wake losses along the trailing edge of the airfoil, then calculating the various wake and shock strength to determine which geometry resulted in lesser shock strength or wake losses.

FIG. 1 is a schematic cross-sectional diagram of a engine 10 for an aircraft, which can be a gas turbine engine, for example. The engine 10 has a generally longitudinally extending axis or engine centerline 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the engine centerline 12. The HP compressor 26, the combustor 30, and the HP turbine 34 form a core 44 of the engine 10, which generates combustion gases. The core 44 is surrounded by a core casing 46, which can be coupled with the fan casing 40.

A HP shaft or spool 48 disposed coaxially about the engine centerline 12 of the engine 10 drivingly connects the HP turbine 34 to the HP compressor 26. ALP shaft or spool 50, which is disposed coaxially about the engine centerline 12 of the engine 10 within the larger diameter of the HP spool 48, drivingly connects the LP turbine 36 to the LP compressor 24 and fan 20. The HP and LP spools 48, 50 are rotatable about the engine centerline 12 and couple to a plurality of rotatable elements, which can collectively define a rotor 51.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 can be provided in a ring and can extend radially outwardly relative to the engine centerline 12, from a blade platform to a blade tip, while the corresponding static compressor vanes 60, 62 are positioned upstream of and adjacent to the rotating blades 56, 58. It is noted that the number of blades, vanes, and compressor stages shown in FIG. 1 were selected for illustrative purposes only, and that other numbers are possible.

The blades 56, 58 for a stage of the compressor can be mounted to a disk 61, which is mounted to the corresponding one of the HP and LP spools 48, 50, with each stage having its a disk 61. The blades 56, 58 may be part of a blisk, rather than being mounted to a disk. The static compressor vanes 60, 62 for a stage of the compressor can be mounted to the core casing 46 in a circumferential arrangement.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 can be provided in a ring and can extend radially outwardly relative to the engine centerline 12, from a blade platform to a blade tip, while the corresponding static turbine vanes 72, 74 are positioned upstream of and adjacent to the rotating turbine blades 68, 70. It is noted that the number of blades, vanes, and turbine stages shown in FIG. 1 were selected for illustrative purposes only, and that other numbers are possible.

The set of turbine blades 68, 70 for a stage of the turbine can be mounted to a disk 71, which is mounted to the corresponding one of the HP and LP spools 48, 50, with each stage having a dedicated disk 71. The vanes 72, 74 for a stage of the turbine can be mounted to the core casing 46 in a circumferential arrangement.

Complimentary to the rotor portion, the stationary portions of the engine 10, such as the static compressor and turbine vanes 60, 62, 72, 74 among the compressor and turbine sections 22, 32 are also referred to individually or collectively as a stator 63. As such, the stator 63 can refer to the combination of non-rotating elements throughout the engine 10.

In operation, the airflow exiting the fan section 18 is split such that a portion of the airflow is channeled into the LP compressor 24, which then supplies pressurized air 76 to the HP compressor 26, which further pressurizes the air. The pressurized air 76 from the HP compressor 26 is mixed with fuel in the combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

A portion of the pressurized air 76 can be drawn from the compressor section 22 as bleed air 77. The bleed air 77 can be drawn from the pressurized air 76 and provided to engine components requiring cooling. The temperature of pressurized air 76 entering and exiting the combustor 30 is significantly increased. As such, cooling provided by the bleed air 77 is supplied to downstream turbine components (e.g., a turbine blade 68) subjected to the heightened temperature environments.

A remaining portion of the airflow exiting the fan section, a bypass airflow 78 bypasses the LP compressor 24 and core 44 and exits the engine 10 through a stationary vane row, and more particularly an outlet guide vane assembly 80, comprising a plurality of airfoil guide vanes 82, at a fan exhaust side 84. More specifically, a circumferential row of radially extending airfoil guide vanes 82 are utilized adjacent the fan section 18 to exert some directional control of the bypass airflow 78.

Some of the air supplied by the fan 20 can bypass the core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid can be, but are not limited to, fluid discharged from the LP compressor 24 or the HP compressor 26.

Figure 2:
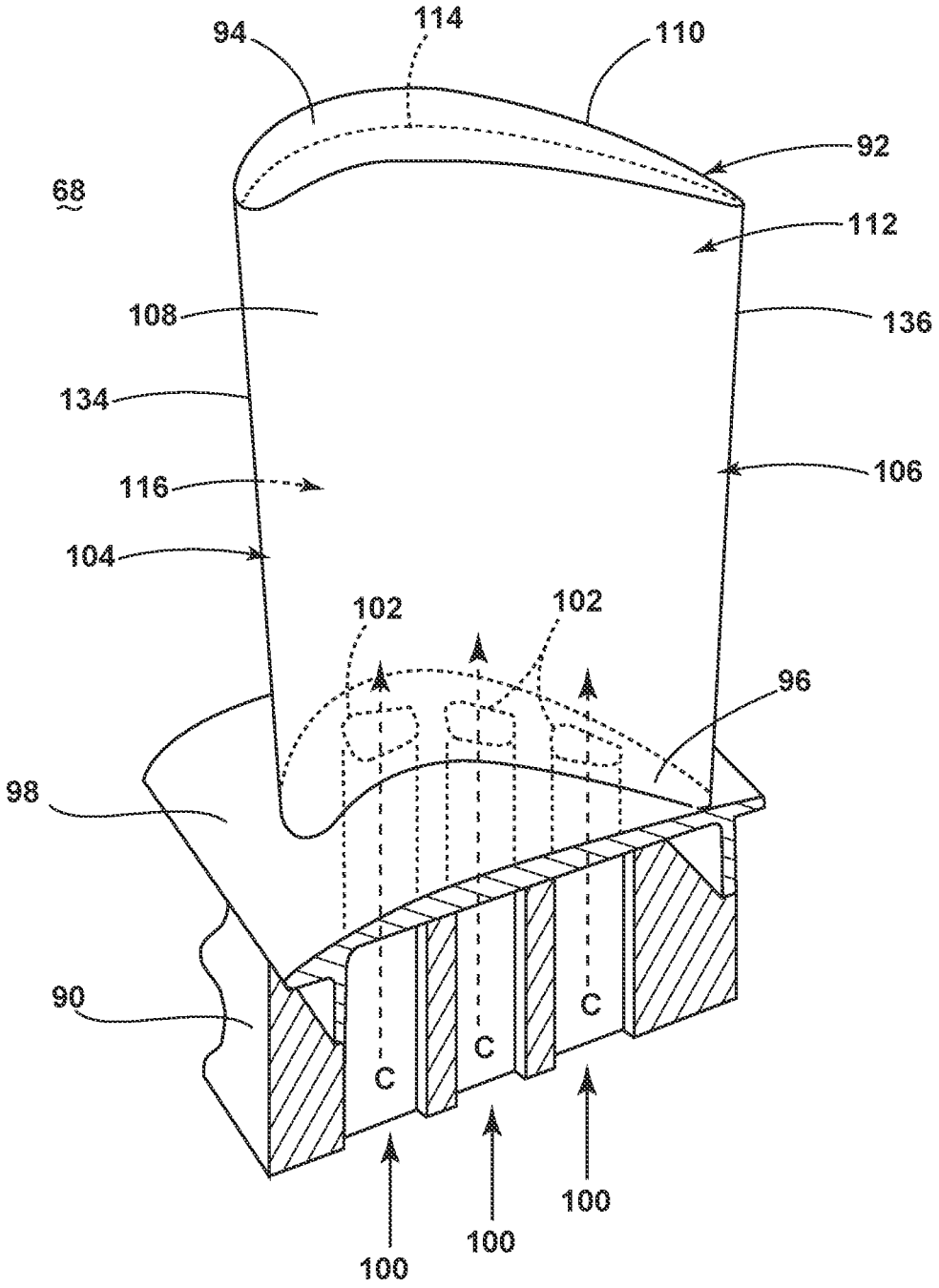
FIG. 2 is a perspective view of an airfoil in the form of a turbine blade of the gas turbine engine from FIG. 1, in accordance with an exemplary embodiment of the present disclosure.

FIG. 2 is a perspective view of one exemplary turbine blade 68 of the engine 10 from FIG. 1. The turbine blade 68 includes a dovetail 90 and an airfoil 92 coupled to and extending from the dovetail 90. The airfoil 92 includes a tip 94 and a root 96, defining a span-wise direction therebetween, and extends between a leading edge structure 104 including a leading edge line 134, and a trailing edge structure 106 including a trailing edge line 136, defining a chord-wise direction between the leading edge structure 104 and the trailing edge structure 106. The airfoil 92 mounts to the dovetail 90 at a platform 98 at the root 96. The platform 98 helps to radially contain the turbine engine mainstream airflow. The dovetail 90 can be configured to mount to the disk 71 on the engine 10 of FIG. 1, for example. The dovetail 90 further includes at least one inlet passage 100, shown as a three exemplary inlet passages 100, each extending through the dovetail 90 to provide internal fluid communication with the airfoil 92 at a passage outlet 102. In one non-limiting example, a cooling fluid flow C, such as the bleed air 77 of FIG. 1, can be provided through the inlet passages 100 to provide interior cooling to the airfoil 92 during operation. It should be appreciated that the dovetail 90 is shown in cross-section, such that the inlet passages 100 are housed within the body of the dovetail 90. The airfoil shape further defines a pressure side 108 and a suction side 110, defining an outer wall 112 for the airfoil 92. The outer wall 112 can surround an interior 116, and can define a camber line 114 extending as the mean distance between the pressure side 108 and the suction side 110 between the leading edge line 134 and the trailing edge line 136.

Figure 3:
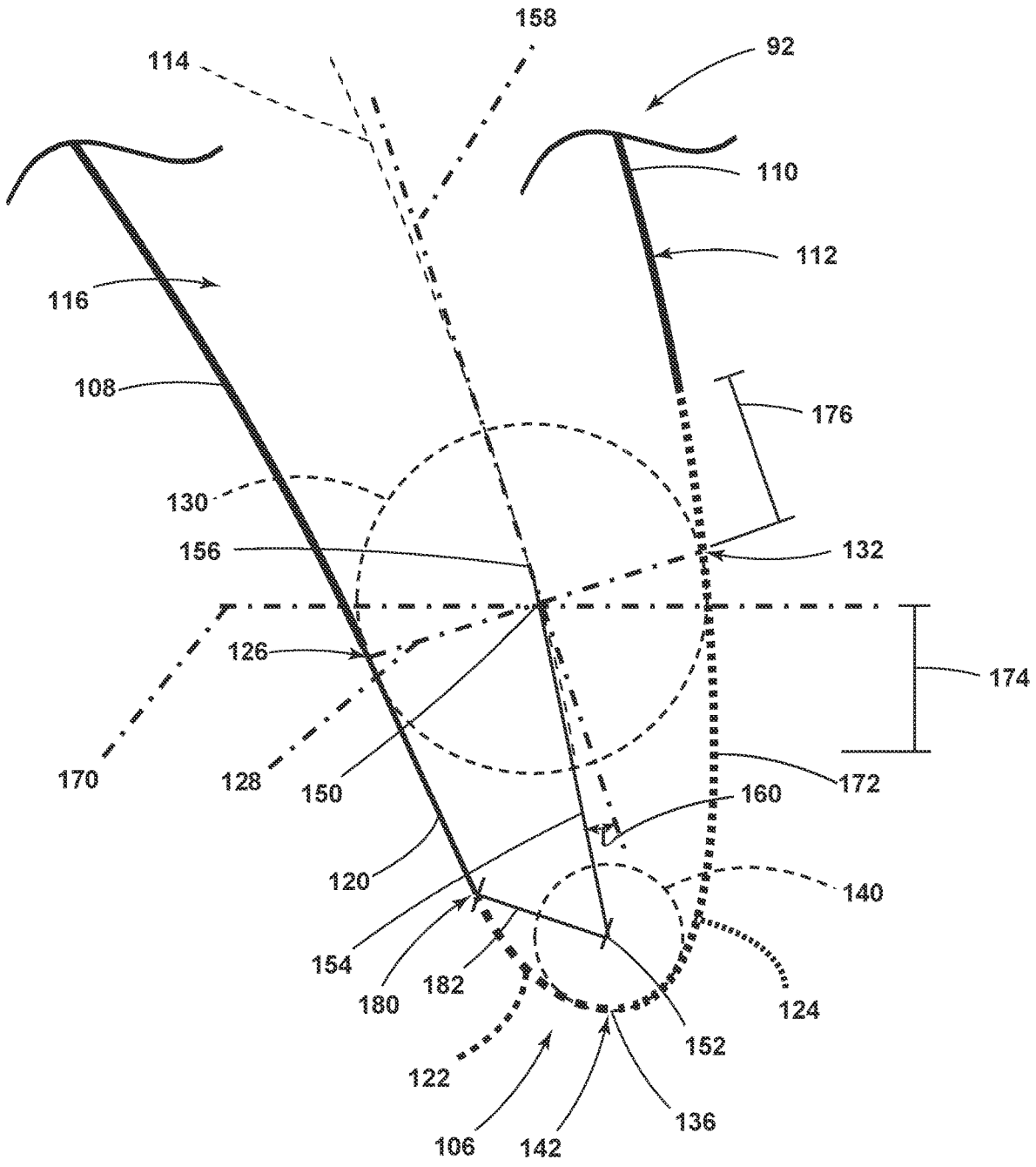
FIG. 3 is a schematic, cross section of a trailing edge of the turbine blade of FIG. 2, in accordance with an exemplary embodiment of the present disclosure.

Referring to FIG. 3, the outer wall 112 at the trailing edge structure 106 is defined by an asymmetrical shape, while maintaining an axial chord. It should be understood that while the airfoil 92 is shown in cross section, the features represented in cross section can extend at least partially or fully between the root 96 and the tip 94 (FIG. 2) in the span-wise direction. Similarly, it should be understood that while portions of the outer wall 112 are shown in broken lines, such broken lines are only included to assist the reader in identifying the different portions of the outer wall 112 and airfoil 92, and it should be understood that the outer wall 112 can be formed as a solid, continuous wall, having a consistent or similar wall thickness, and the broken lines are to facilitate understanding only.

The asymmetric shape can be defined by the outer wall 112 at the trailing edge structure 106. More specifically, the trailing edge structure 106 can include a linear portion 120 extending partially between the pressure side 108 and the trailing edge line 136. The linear portion 120 can be arranged tangent to the pressure side 108. Due to the airfoil shape of the outer wall 112, the pressure side 108 is at least partially curved, defining at least a non-zero or non-infinite radius of curvature. The linear portion 120 defines a plane extending at least partially between the root 96 and the tip 94 in the span-wise direction, and the plane thereof is arranged tangent to the suction side 110 as it extends in the span-wise direction.

A first curved portion 122 can extend between the linear portion 120 and the trailing edge line 136 and a second curved portion can extend between the first curved portion 122 at the trailing edge line 136, and the suction side 110. The first curved portion 122 can include a circular or elliptical curvature, for example, and the first curved portion 122 can be arranged tangent to the linear portion 120 where the first curved portion 122 meets the linear portion 120.

A second curved portion 124 extends between the first curved portion 122 and the suction side 110, and can be defined by an elliptical or circular curvature, for example, while other curvatures are contemplated. Both the first curved portion 122 and the second curved portion 124 have a common radius of curvature where the second curved portion 124 adjoins to the first curved portion 122. Similarly, the first and second curved portion 122, 124 are arranged tangent to one another at the trailing edge line 136. More specifically, both the first and second curved portions 122, 124 are arranged tangent to a circle defined by the common radius of curvature among the first and second curved portions 122, 124 at their junction at the trailing edge line 136. Additionally, the second curved portion 124 can be arranged tangent to the suction side 110 where the second curved portion 124 meets the suction side 110.

A first junction 126 can be defined where the linear portion 120 meets the pressure side 108. A virtual diameter 128 can extend from the outer wall 112 at the first junction 126 from the pressure side 108, through the interior 116, to the suction side 110, and can define a first virtual circle 130 as the diameter thereof. The virtual diameter 128 can be defined parallel to the camber line 114, for example, and positioned such that the virtual diameter 128 also intersects the first junction 126. Alternatively, it is contemplated that the virtual diameter 128 is defined perpendicular to the outer wall 112 at the first junction 126. The virtual diameter 128 can further be defined extending between the pressure side 108 and the suction side 110, such that the first virtual circle 130 is defined between the pressure side 108 and the suction side 110 by the virtual diameter 128. A second junction 132 can be defined along the second curved portion 124, opposite of the first junction 126, defining the virtual diameter 128 for the first virtual circle 130 therebetween.

A second virtual circle 140 can be defined at a third junction 142. The third junction 142 can be defined where the first curved portion 122 meets the second curved portion 124, and can be arranged at the trailing edge line 136. The second virtual circle 140 can be defined such that the first and second curved portions 122, 124 are arranged tangent to one another and the second virtual circle 140, and a radius for the second virtual circle 140 can be defined equal to the radius of curvature for both the first and second curved portions 122, 124 at the third junction 142.

The first virtual circle 130 can define a first centerpoint 150 and the second virtual circle 140 can define a second centerpoint 152. A virtual line 154 can be defined between the first centerpoint 150 and the second centerpoint 152. The virtual line 154 can intersect the camber line 114 at an intersection 156. The particular geometry for the airfoil 92 can define the position of the intersection 156, and can be arranged at the first centerpoint 150, for example, or where such an intersection is between or is not between the first centerpoint 150 and the second centerpoint 152. A tangent line 158 can be defined tangent to the camber line 114 at the intersection 156. A first angle 160 can be defined between the tangent line 158 and the virtual line 154 at the intersection 156.

An axial axis 170 can be defined in the axial direction and can intersect the first centerpoint 150. In one non-limiting example, the axial axis 170 can be parallel to the engine centerline 12 of FIG. 1. An aft point 172 can be defined as the aft-most point defined along the second curved portion 124. A first spacing distance 174 can be defined as the shortest distance between the aft point 172 and the axial axis 170, which can be defined perpendicular to the axial axis 170, for example. A second spacing distance 176 can be defined as the distance between the second junction 132, and the junction between the second curved portion 124 and the suction side 110.

During manufacture of the airfoil 92, the length for the linear portion 120 can be defined extending from the pressure side 108 toward the trailing edge line 136, defining the first junction 126. Similarly, the virtual diameter 128 can be defined extending between the first junction 126 and the second curved portion 124, which can define the first centerpoint 150 of the first virtual circle 130 as defined by the virtual diameter 128. The length for the virtual line 154, as well as the first angle 160, can be defined in order to define the position of the second centerpoint 152 relative to the first centerpoint 150. The position of the aft point 172 can be defined, which can then determine the curvatures defining the first and second curved portions 122, 124. More specifically, the curvature for the second curved portion 124 is defined based upon the requirement to be tangent to the suction side 110, intersecting the aft point 172, and adjoining the first curved portion 122 tangent at the trailing edge line 136. Similarly, the curvature of the first curved portion 122 can be defined based upon the requirement to be tangent to the linear portion 120 and adjoining the second curved portion 124. Such curvatures can be elliptical, for example, while alternative curvatures are contemplated including but not limited to, elliptical, circular, conic, parabolic, hyperbolic, logarithmic, rho-conic, or higher-order curves, such as Bezier and rational Bezier curves, or combinations thereof, in non-limiting examples. Where higher-order curves are used, the areas defining the first and second curved portions 122, 124 could be a 3rd order or a 4th order, while greater or lesser orders are contemplated. Furthermore, the radius for the second virtual circle 140 can be defined, such that the radius defines the distance between the second centerpoint 152 and the junction between the first curved portion 122 and the second curved portion 124 at the trailing edge line 136. Defining this radius defines the curvature for the first and second curved portions 122, 124. More specifically, as the first and second curved portions 122, 124 are arranged tangent to the second virtual circle 140, defining the radius of the second virtual circle 140 defines the curvature for the first and second curved portions 122, 124 in order to meet the tangent arrangement requirement. Alternatively, the curvatures for the first and second curved portions 122, 124 can be used to define the radius, which defines the second virtual circle 140.

In one example, a fourth junction 180 can be defined where the linear portion 120 meets the first curved portion 122. An end distance 182 can be defined as the distance between the fourth junction 180 and the second centerpoint 152. The end distance 182 can be greater than or equal to the radius of the second virtual circle 140. In another example, the virtual diameter 128 for the first virtual circle 130 can be greater than a diameter of the second virtual circle 140.

In yet another example, the first spacing distance 174 and the second spacing distance 176 can be varied. Such a variation can be used to define the position of the junction between the suction side 110 and the second curved portion 124, as well as the aft point 172, or vice-versa, where defining the junction or aft point 172 defines the first and second spacing distances 174, 176. Specifying the position of the aft point 172, and therefore the curvature of the second curved portion 124, can be used to maintain sufficient axial chord to maintain constant aerodynamic loading along the suction side 110.

In additional non-limiting examples, a ratio of the length of the linear portion 120 to the virtual diameter 128 for the first virtual circle 130 can be between 0.1 and 1.3. A ratio of the diameter of the second virtual circle 140 to the virtual diameter 128 of the first virtual circle 130 can be between 0.2 and 1.0. The first angle 160 can be between about 5-degrees and about 25-degrees, while greater or lesser angles are contemplated. A ratio of the length of the virtual line 154 to the length of the virtual diameter 128 can be between 0.5 and 1.25. A ratio of the first spacing distance 174 to the length of the virtual diameter 128 can be between 0.1 and 1.0. A ratio of the second spacing distance 176 to the length of the virtual diameter 128 can be between 0.1 and 0.65. It should be understood that greater or other ranges for the above-identified values or ratios is contemplated, and that particular values can be tailored to particular engines, airfoils, or operating conditions.

Based upon the foregoing, it should be appreciated that the geometry and shape for the airfoil 92 can be defined, and more specifically, the outer wall 112 near and at the trailing edge structure 106 can be defined. Such a geometry provided herein reduces wake and shock generated at the trailing edge structure 106, as well as reducing the associated efficiency losses resultant thereof. Furthermore, such a reduction also reduces shock interactions among neighboring airfoils, which results in a further reduction in associated efficiency losses among sets of multiple airfoils, or for whole stages.

The geometry provided herein provides for extending the pressure side 108 via the linear portion 120, which avoids or reduces near-trailing-edge acceleration, where such acceleration can otherwise strengthen the shock ultimately generated. The first curved portion can provide to reduce vortex generation, or strength thereof, along the pressure side, and the second curved portion can delay flow detachment along the suction side, which can shock strength. Furthermore, specifying the relative position of the aft point 172 in order to define a higher-order curvature for the second curved portion 124, relative to that of the suction side 110 prior to the second curved portion 124, can delay the separation of the boundary layer from the airfoil suction side 110 as the flow approaches the trailing edge line 136. Delayed boundary layer separation results in a thinner wake, which ultimately improves the efficiency of the airfoil and reduces the potential for losses within downstream stages or airfoils, increasing overall engine efficiency.

Furthermore, it should be appreciated that such a geometry is advantageous for use with supersonic airfoils or local supersonic exit-flow conditions at the airfoil or respective stage. Reducing the wake and resultant shock can permit use at operational conditions with local flow speeds reaching relatively higher Mach numbers, as mitigating the wake and shock permits the use of higher local flow speeds, which can increase efficiency and permit higher turbine power output.

Further yet, while the linear portion 120 and the second curved portion 124 can provide for a reduction in the wake and resultant shock, the other geometries provided herein can be used to tailor the shapes, sizes, lengths, or otherwise for the airfoil 92. Such tailoring can include, in non-limiting examples, varying the length of the virtual line 154, the angle of the first angle 160, the radius of the second virtual circle 140, the relative position of the second centerpoint 152, the curvature of the first curved portion 122, the relative position of the first junction 126, the first spacing distance 174, or the second spacing distance 176, as well as tailoring the distance of the linear portion 120 or the relative axial position of the aft point 172. Tailoring the particular geometry or the shape can be used to tailor the airfoil 92 to the particular operating system or condition. For example, tailoring the geometry can be based upon which stage the airfoil 92 is located, whether the airfoil 92 is in the compressor section or the turbine section, whether the airfoil 92 is in the high-pressure or low-pressure compressor or turbine, whether the airfoil 92 is a rotating blade or a stationary vane, the local operating temperatures, whether the airfoil 92 is uncooled (solid) or cooled (having internal passages), and threshold operational conditions, such as maximum rotational speed or maximum operational temperature, or flight condition, such as take-off, cruise, ascend, or descend. Tailoring the geometry to the condition can further increase efficiency gains by utilizing the particular operational conditions in which the airfoil 92 is intended for use.

Figure 4:
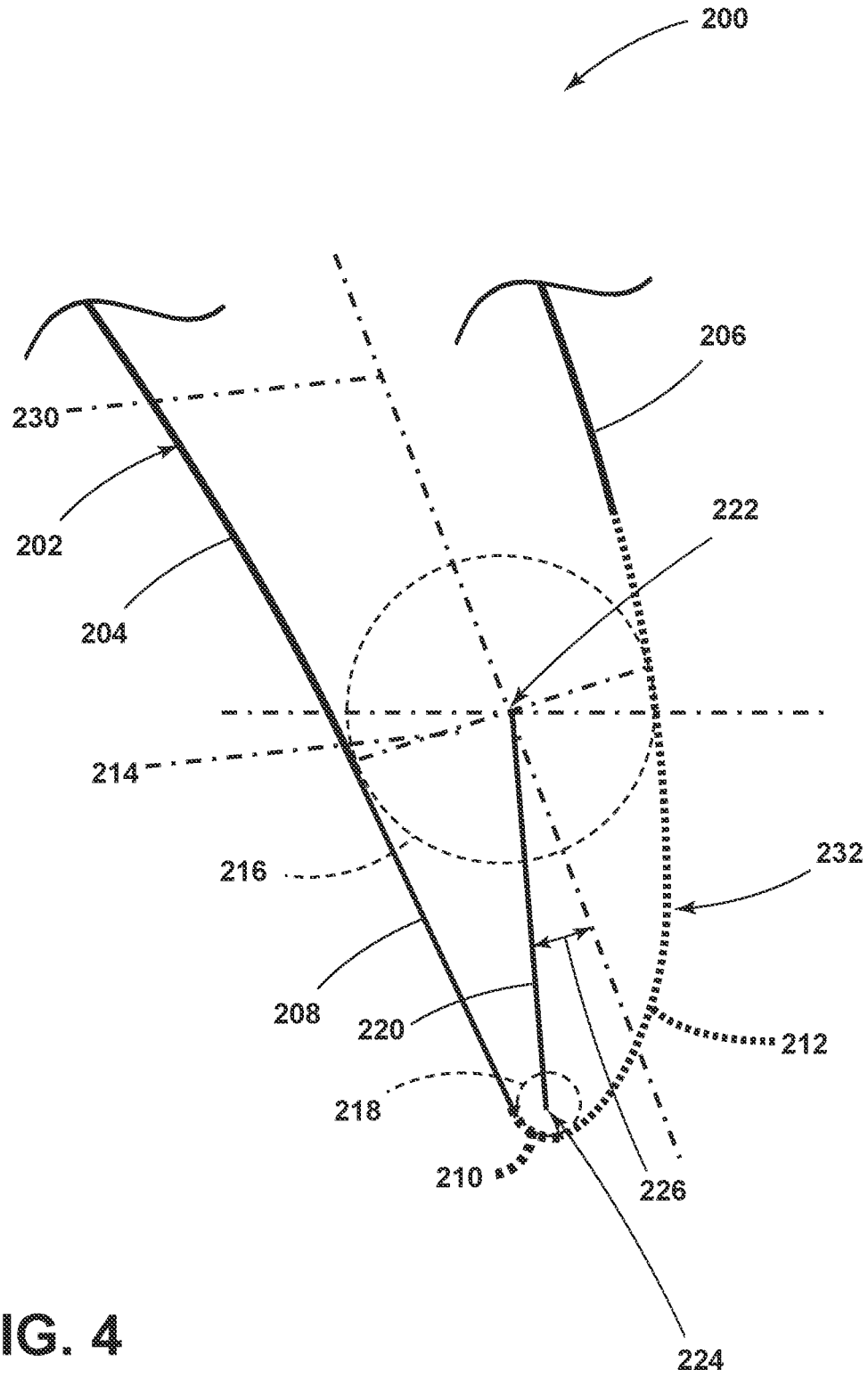
FIG. 4 is a schematic, cross section of an alternative trailing edge for a turbine blade, in accordance with an exemplary embodiment of the present disclosure.

Referring to FIG. 4, an exemplary airfoil 200 includes an outer wall 202 with a pressure side 204 and suction side 206. The airfoil 200 includes a linear portion 208, a first curved portion 210, and a second curved portion 212 having an aft point 232. A virtual diameter 214 defines a first virtual circle 216. Relative to the airfoil 92 of FIGS. 2-3, the airfoil 200 includes a relatively larger length for the linear portion 208, as well as a relatively smaller diameter defining a second virtual circle 218, which partially defines the first and second curved portions 210, 212. A virtual line 220 defined between a center 222 of the first virtual circle 216 and a center 224 of the second virtual circle 218 can be include a relatively longer length, and is shown having a relatively greater angle 226 defined between the virtual line 220 and a line 230 tangent to a camber-line of the airfoil 200 where the virtual line 220 intersects the line 230.

Figure 5:
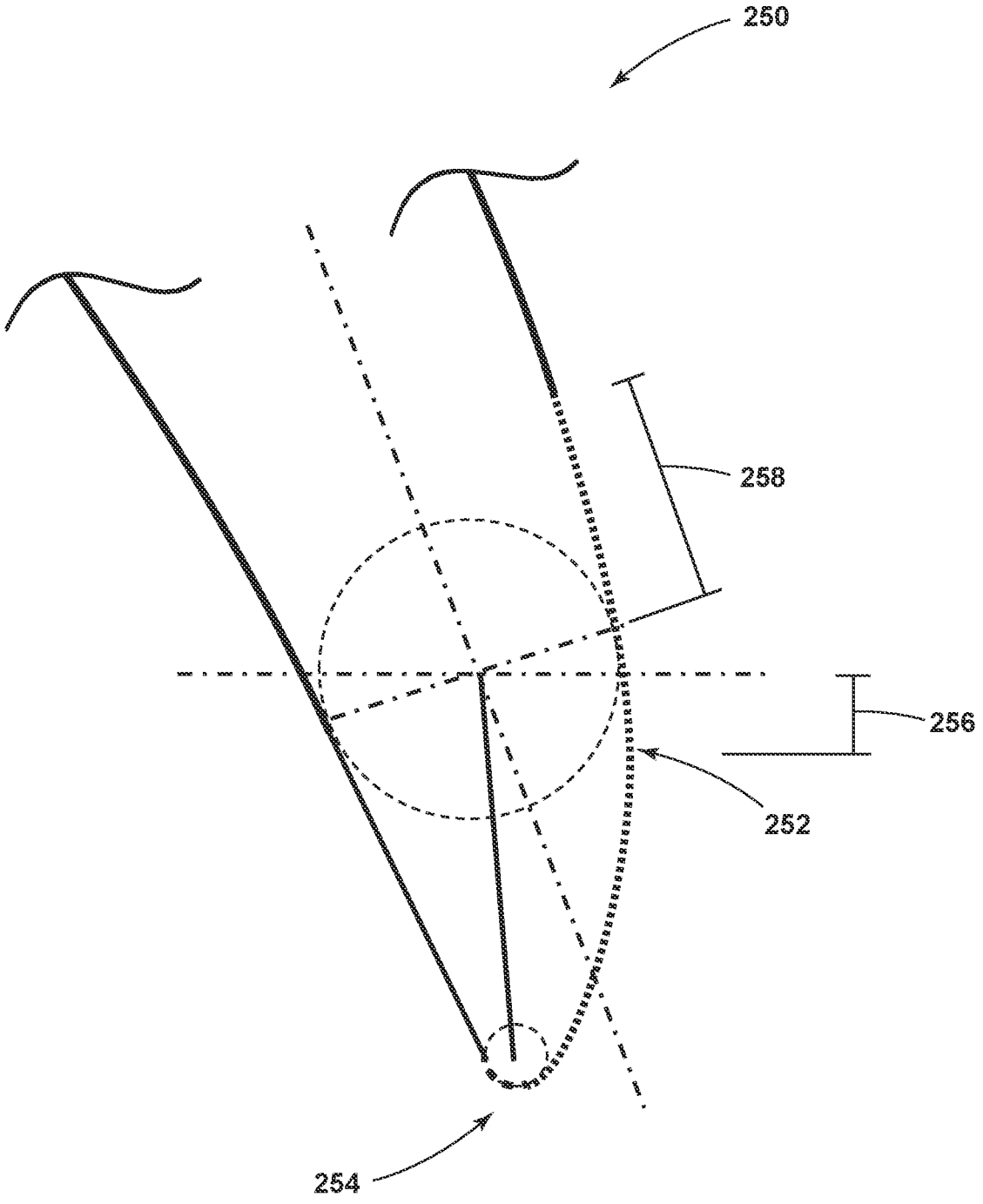
FIG. 5 is a schematic, cross section of another alternative trailing edge for a turbine blade, in accordance with an exemplary embodiment of the present disclosure.

Referring to FIG. 5, another exemplary airfoil 250 can be substantially similar to the airfoil 200 of FIG. 4, with the difference including the position of an aft point 252 being relatively further from a trailing edge line 254 than that of FIG. 4. Such a variation can define a relatively smaller first spacing distance 256 and a relatively larger second spacing distance 258, being relative to that of the airfoil 200 of FIG. 4.

Figure 6:
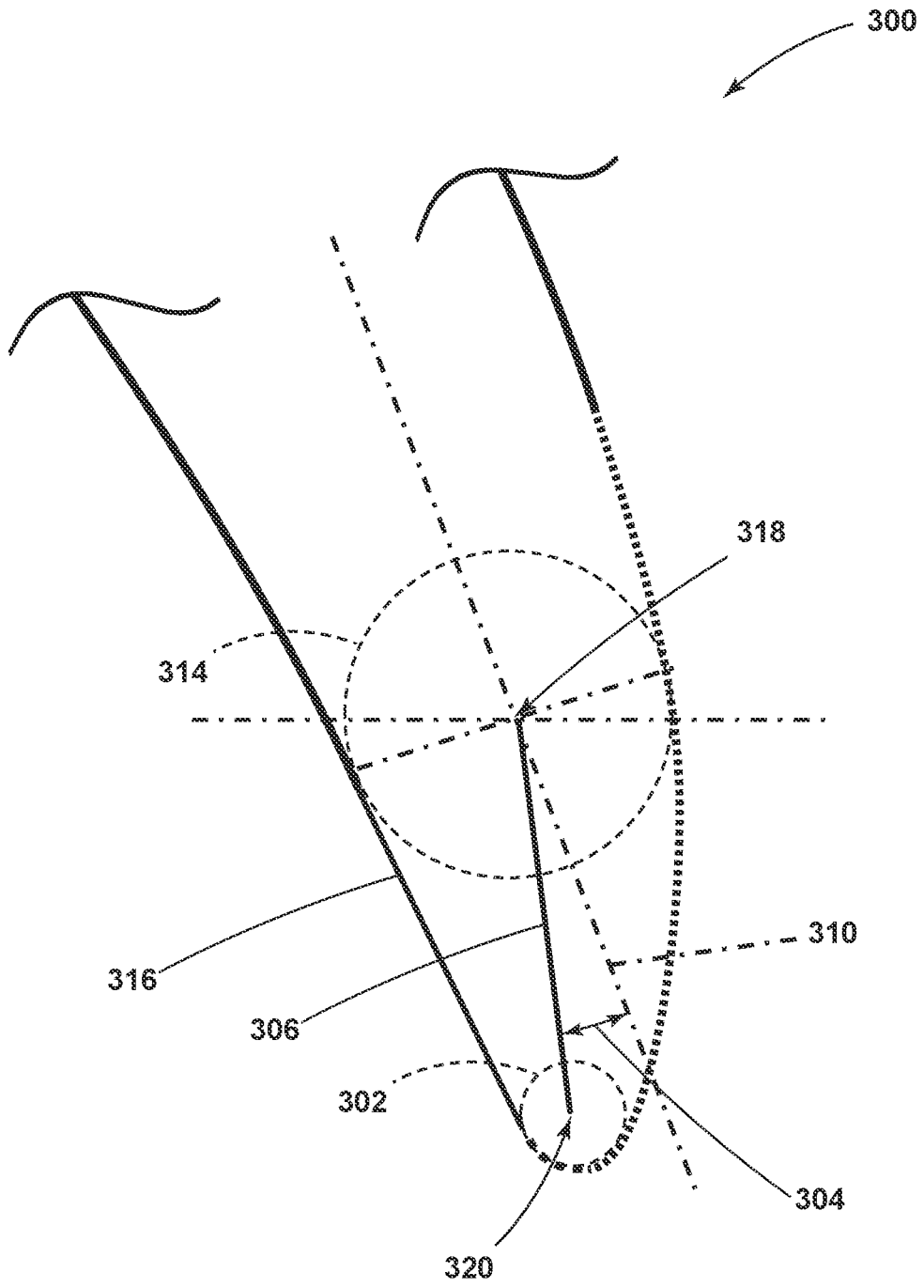
FIG. 6 is a schematic, cross section of yet another alternative trailing edge for a turbine blade, in accordance with an exemplary embodiment of the present disclosure.

Referring to FIG. 6, yet another exemplary airfoil 300 can be substantially similar to the airfoil 250 of FIG. 5, with the difference including the diameter of a second virtual circle 302 being relatively larger than that of FIG. 5. In order to account for such a variation, an angle 304 defined between a virtual line 306, defined between a center 318 of a first virtual circle 314 and a center 320 of the second virtual circle 302, and a line tangent to a camber-line axis 310, can be varied, as well as a length of the virtual line 306. Such adjustments of the angle 304 and the length of the virtual line 306 permits maintaining the length of a linear portion 316, while permitting the variation of the diameter of the second virtual circle 302, relative to the smaller diameter as shown in FIG. 5.

Figure 7:
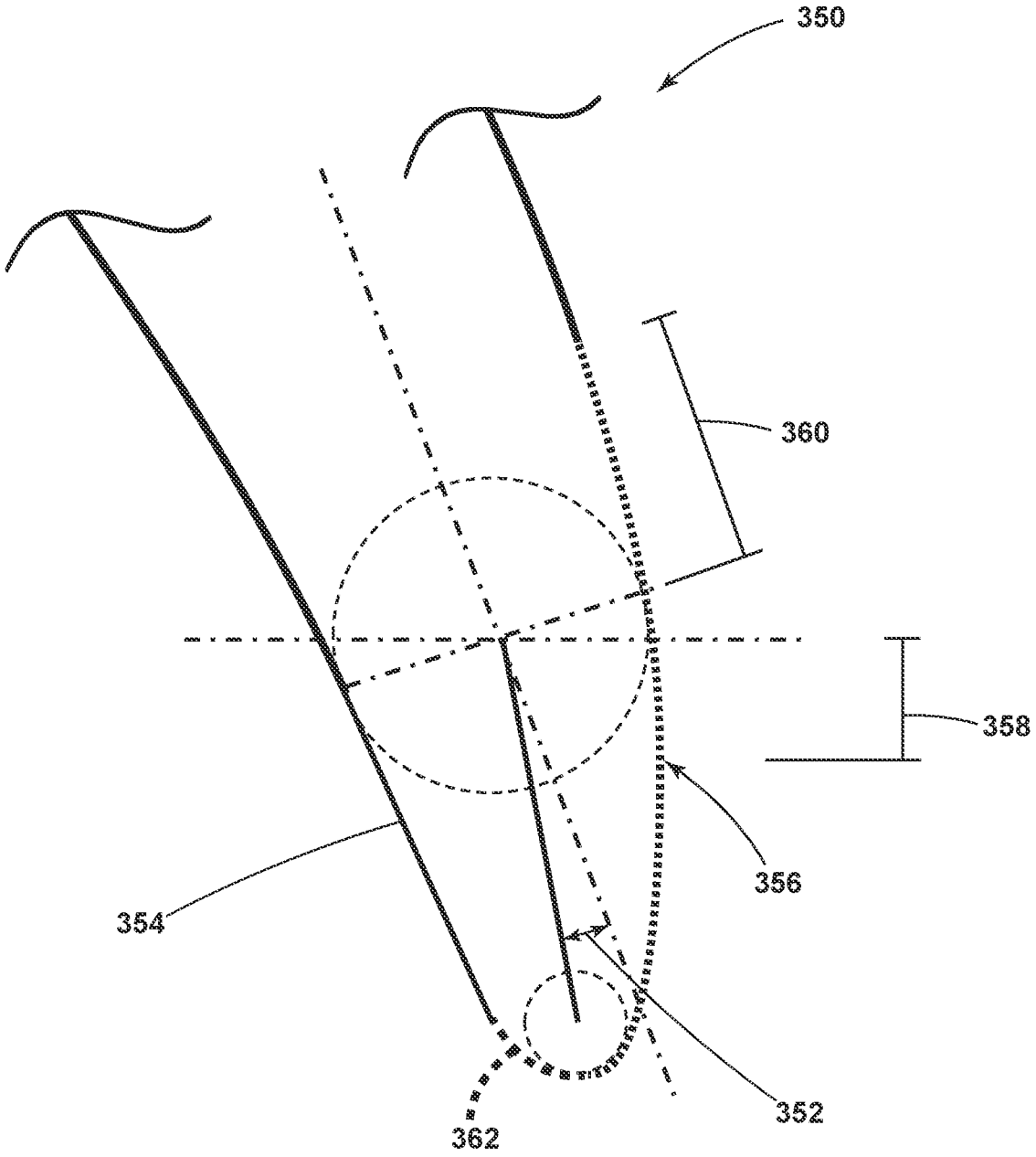
FIG. 7 is a schematic, cross section of still another alternative trailing edge for a turbine blade, in accordance with an exemplary embodiment of the present disclosure.

Referring to FIG. 7, another exemplary airfoil 350 can be substantially similar to the airfoil 300 of FIG. 6, with the difference including an angle 352 being relatively lesser than the angle 304 of FIG. 6. In order to account for the variation in the angle 352, while generally maintaining a similar length for a linear portion 354, an aft point 356, a first spacing distance 358, and a second spacing distance 360, the radius of curvature defined along a first curved portion 362 can be varied. Such a variation accounts for the relatively lesser angle 352, while still maintaining a tangent junction between the first curved portion 362 and the linear portion 354.

Considering FIGS. 4-7, it should be appreciated that the length of the linear portion can be relatively increased or decreased for the particular airfoil. Such variation of the linear portion can be tailored to the particular pressure side of the airfoil, among other things, to reduce or eliminate flow acceleration provided by the pressure side prior to the linear portion. The length of the linear portion can be tailored to the particular engine or operating conditions thereof, in order to reduce the acceleration to a desired rate based upon the particular engine or operating conditions. Similarly, the curvature of the first and second curved portions can be varied. Such a variation can be used to tailor the shape of the trailing edge to reduce local acceleration and shock strength generated at the pressure side and delay flow detachment at the suction side. The tailoring can include varying the curvature of the first and second curved portions, which can tailor such acceleration or delayed flow detachment to the particular engine or operating conditions thereof. Modelling, for example, can be utilized to determine optimal geometries for airfoils based upon anticipated operating conditions for the particular engine.

Figure 8:
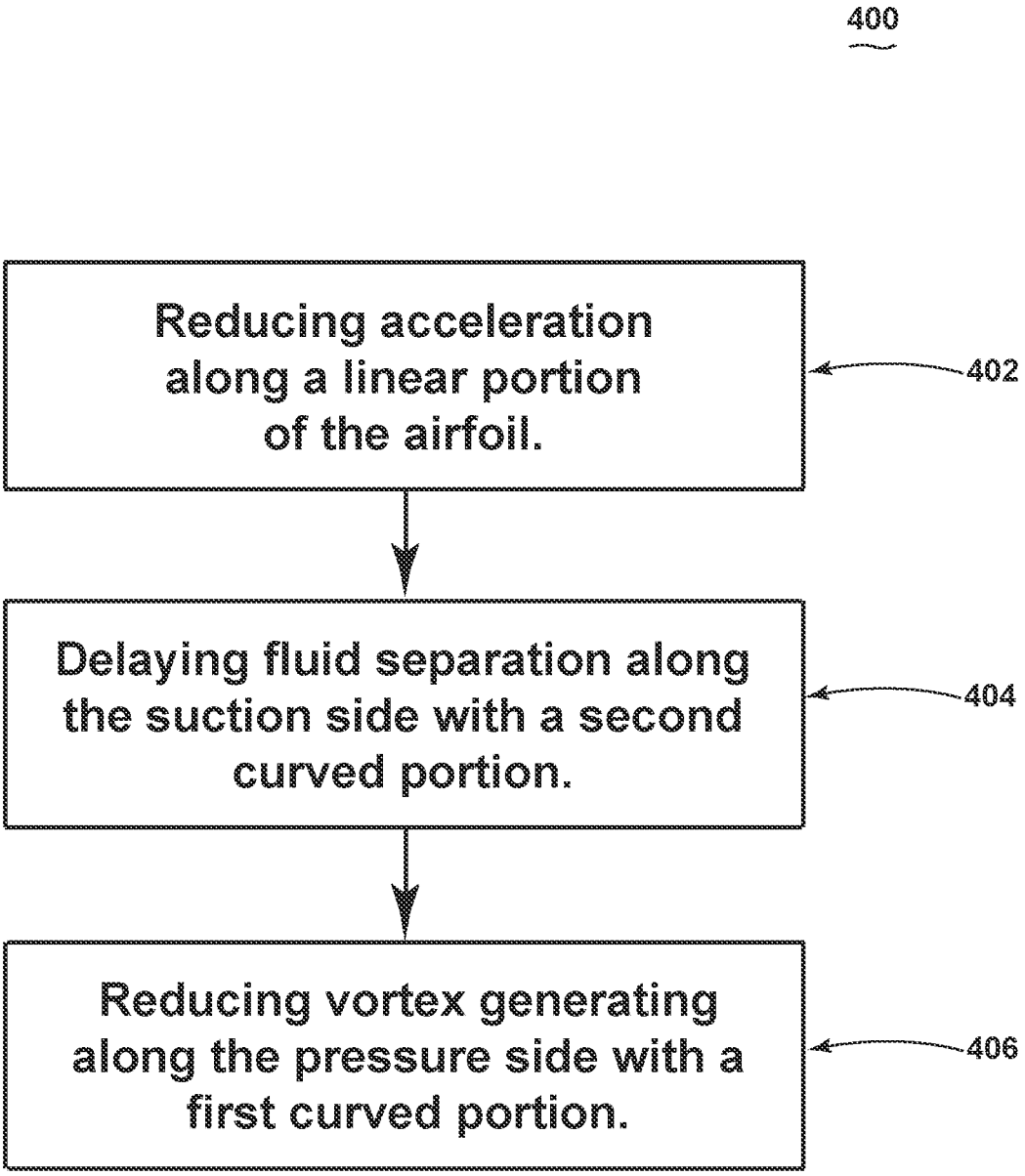
FIG. 8 is a flow chart illustrating a method of reducing wake losses and shock strength along an airfoil in accordance with an exemplary embodiment of the present disclosure.

Referring to FIG. 8, a flow chart depicts a method 400 of reducing wake losses and shock strength along an airfoil for a turbine engine. The method 400 includes, at 402, reducing acceleration of a portion of a fluid along a linear portion of the airfoil, with the linear portion extending at least partially between the pressure side and the trailing edge. The reduction in acceleration for the fluid is resultant of linear portion, which can be the linear portion 120, 208, 316, 354 as disclosed herein, for example. The linear portion provides for reducing acceleration of a fluid otherwise accelerated along the pressure side of the airfoil.

At 404, the method can further include delaying separation of a second portion of the fluid from the suction side of the airfoil by passing the second portion of the fluid along a second curved portion, where the second curved portion is arranged between the suction side and the trailing edge, and arranged tangent to the suction side. The curvature of the second curved portion provides for increased flow attachment along the suction side, which delays flow separation from the suction side prior to the trailing edge.

At 406, the method can further include reducing vortex generation for an airfoil with a first curved portion provided between the linear portion and the second curved portion, at the trailing edge. The first curved portion can be arranged tangent to the linear portion and the second curved portion.

The geometry for the first curved portion provides for reducing vortex generation at the trailing edge. Such a reduction results in relatively lesser shock generated by the airfoil, particularly with supersonic flow speeds.

The method 400 herein provides a geometry for an airfoil that can reduce wake losses and shock strength for an airfoil. More specifically, the linear portion utilized between the curved pressure side surface and the first curved portion reduces acceleration of the airflow moving along the pressure side, which reduces shock strength, as compared with an airfoil without one or both of the linear portion or the first curved portion. Furthermore, the second curved portion, extending from the suction side, provides to delay flow separation from the airfoil along the suction side. Delaying flow separation reduces the suction side width, and therefore the overall width, of the airfoil wake. Reducing the overall wake width reduces mixing losses aft of the airfoil trailing edge, which provides for higher efficiency. Further, a smaller overall wake reduces unsteady interaction losses in the adjacent downstream row of airfoils.

Figure 9:
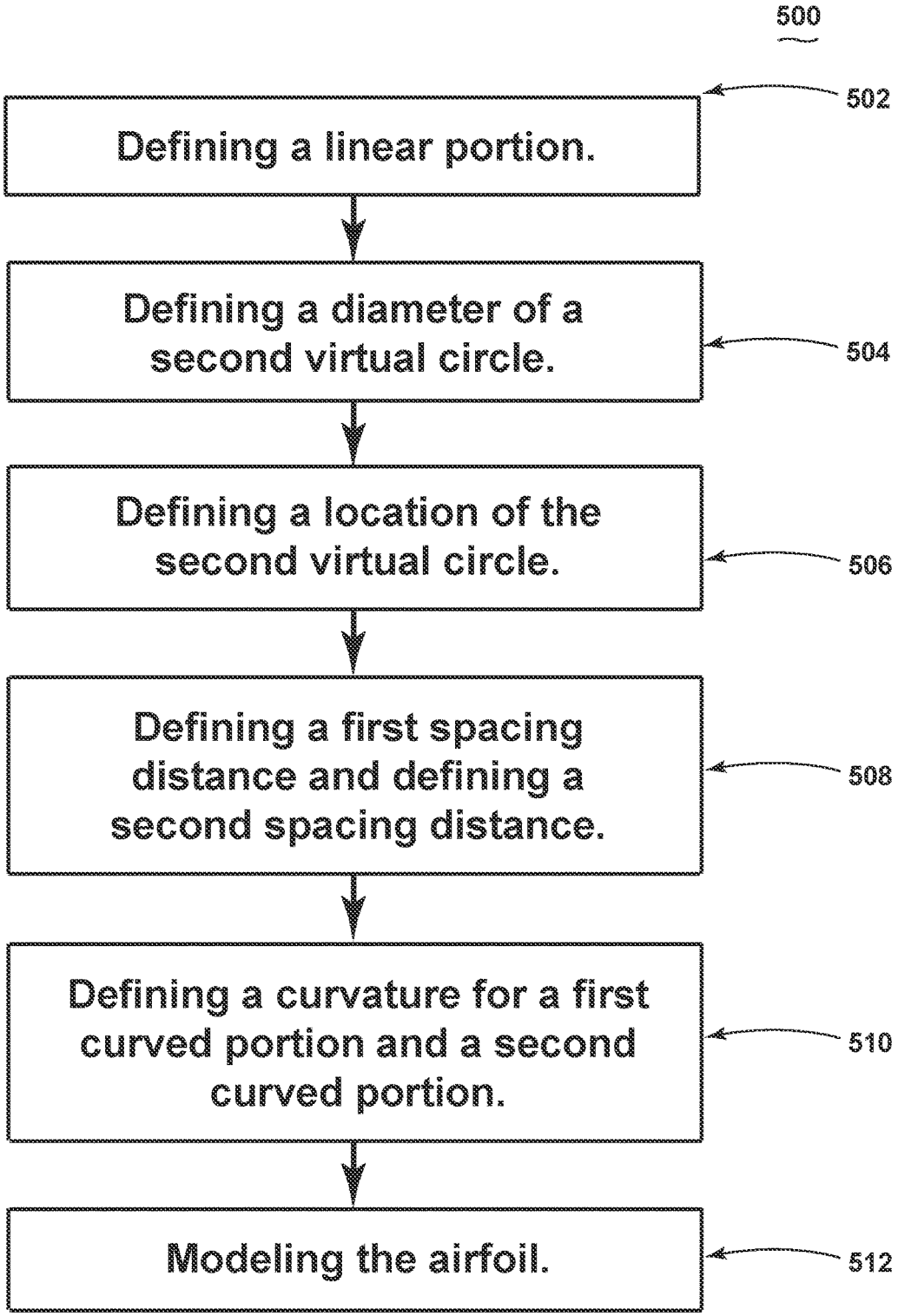
FIG. 9 is another flow chart illustrating a method of forming an airfoil for a turbine engine in accordance with an exemplary embodiment of the present disclosure.

Referring to FIG. 9, another flow chart depicts a method 500 of forming an airfoil for a turbine engine. The method 500 includes, at 502, defining a linear portion extending from the pressure side of the airfoil, such as the linear portions 120, 208, 316, 354 as disclosed herein. At 504, the method 500 can include defining the diameter of a second virtual circle, such as the circles 140, 218, 302. Defining the diameter of the second virtual circle ensures that the curvature at the trailing edge is provided within mechanical and heat transfer constraints for an intended operation.

At 506, the method 500 can include defining the location of the second virtual circle. The location can be defined relative to the linear portion, and arranged based upon the diameter defined at 504. Additionally, defining the location of the second virtual circle provides to define the first angle 160, as the location defines the centerpoint for the second circle.

At 508, the method 500 can include defining a first spacing distance and a second spacing distance, which can be the first spacing distance 174, 256, 358 and the second spacing distance 176, 258, 360 as described herein. Defining the first and second spacing distances sets the positions for the tangency points for a second curved portion, which can be the second curved portion 124, 212 as described herein. Defining these tangency points limits the curvatures for the first and second curved portions.

At 510, the method 500 can include defining curvatures for the first and second curved portions. The first curved portion will be limited by being tangent the second curved portion and the linear portion, while the second curved portion will be limited by being tangent to the suction side and the first curved portion. The position of those tangency points will be defined by the first and second spacing distances, the position and diameter of the second virtual circle, and the length and position of the linear portion.

At 512, virtual or physical modelling of the airfoil can be performed to measure and minimize a net balance of shock and wake losses. Such modelling can include computational fluid dynamics (CFD) or cascade tests in non-limiting examples. The method 500 can be repeated at 502 through 510, varying the definitions defined therein, in order to tailor the generated shock and wake losses to the particular engine or use thereof. Such variation can include, but is not limited to, varying the length of the linear portion, varying the length of the first or second virtual diameters, varying the position of the first or second virtual circles, varying the size, shape, length, or curvature of the first and second curved portions, varying the first and second spacing distances to vary the position of the tangency point or the aft point for the second curved portion, or varying any of the other structural features, sizes, distances, spacing, or curves thereof in order to vary the overall shape of the airfoil.

The method 500 herein provides a defining and forming an airfoil that can reduce wake losses and shock strength. More specifically, the linear portion, the first or second curved portions, the virtual circles or diameters thereof, the spacing distances, the aft point, or other structural features can be varied to reduce acceleration of the airflow moving along the pressure side, which reduces shock strength for the wake generated by the airfoil, as compared with an airfoil without one or more of those structural features. The second curved portion delays flow separation from the airfoil along the suction side, which can reduce overall width of the airfoil wake, thus reducing the mixing loss incurred downstream of the airfoil.

During operation, movement of fluid over the airfoils generates a wake downstream of the airfoil. The rapid acceleration of fluid along the pressure side of the airfoil, followed by the compression at the trailing edge generates a shock pattern. The shock emanates from the pressure side of the trailing edge and spans across the flow passage, where it reflects off of the suction surface of the circumferentially adjacent airfoil. The geometry for the airfoil provided herein, near or about the trailing edge, can provide for a reducing the strength of this shock, thereby reducing the passage losses associated therewith. Furthermore, collectively considering the reduction in strength and losses, the overall losses resultant of interaction among neighboring nozzles or airfoils is reduced, further increasing overall engine efficiency.

It should be further appreciated that such benefits have further advantages with transonic or supersonic flow speeds. Supersonic flow speeds along the airfoils can result in supersonic shockwaves being generated by the airfoil, which can have significant impacts on engine performance and resilience. Reducing or mitigating these shock forces can permit the use of higher flow speeds, such as transonic or supersonic flow speeds along the airfoils, which can result in increased overall turbine power, which may otherwise be commercially or functionally impractical without utilizing the airfoil geometry provided herein.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses:

A gas turbine engine comprising: a compressor section, a combustion section, and a turbine section in serial flow arrangement; and an airfoil including an outer wall bounding an interior, the outer wall comprising: a leading edge structure defining a leading edge line; a trailing edge structure spaced from the leading edge structure and defining a trailing edge line, with a chord defined by a line extending between the leading edge line and trailing edge line; a pressure side extending between the leading edge structure and the trailing edge structure; a suction side extending between the leading edge structure and the trailing edge structure, and defining a camber line relative to the pressure side; wherein the trailing edge structure comprises: a linear portion extending from the pressure side toward the trailing edge line; a first curved portion extending between the linear portion and the trailing edge line; and a second curved portion extending between the suction side and the trailing edge line.

The gas turbine engine of any preceding clause wherein the linear portion is arranged tangent to the pressure side.

The gas turbine engine of any preceding clause wherein the linear portion is arranged tangent to the first curved portion.

The gas turbine engine of any preceding clause further comprising a virtual diameter defined between the second curved portion and a junction where the pressure side meets the linear portion; wherein the virtual diameter defines a first virtual circle with a first centerpoint; wherein a radius of curvature, defined where the first curved portion and the second curved portion meet at the trailing edge, defines a second virtual circle with a second centerpoint; wherein a virtual line is defined by the first centerpoint and the second centerpoint; wherein a tangent line is defined tangent to the camber line and extending from the first centerpoint, with the camber tangent line arranged at an angle relative to the virtual line; and wherein the angle is between about 5-degrees and about 25-degrees.

The gas turbine engine of any preceding clause wherein the linear portion includes a length and a ratio of the length to the virtual diameter is between 0.1 and 1.3.

The gas turbine engine of any preceding clause wherein the second virtual circle defines a second virtual diameter, and wherein a ratio of the virtual diameter to the second virtual diameter is between 0.2 and 1.0.

The gas turbine engine of any preceding clause wherein the virtual line includes a length, and a ratio of the length of the virtual line to a length of the virtual diameter is between 0.5 and 1.25.

The gas turbine engine of any preceding clause wherein a third junction is defined where the virtual diameter meets the second curved portion, an aft point is defined at the aft-most position of the second curved portion, an axial axis extends axially from the first centerpoint, a first spacing distance is defined as the distance between the third junction and where the second curved portion meets the pressure side, and a second spacing distance is defined as the shortest distance between the aft point and the axial axis, wherein a ratio of the first spacing distance to a length of the virtual diameter is between 0.1 and 1.0.

The gas turbine engine of any preceding clause wherein a ratio of the second spacing distance to the length of the virtual diameter is between 0.1 and 0.65.

The gas turbine engine of any preceding clause wherein a fourth junction is defined where the linear portion meets the first curved portion, and a distance between the fourth junction and the second centerpoint is greater than or equal to a diameter for the second virtual circle.

The gas turbine engine of any preceding clause wherein the first curved portion and the second curved portion define a common radius of curvature at the trailing edge.

The gas turbine engine of any preceding clause wherein the common radius of curvature defines a second virtual circle, and the first curved portion and the second curved portion are arranged tangent to the second virtual circle at the trailing edge.

The gas turbine engine of any preceding clause wherein the second curved portion is arranged tangent to the suction side.

An airfoil for a turbine engine, the airfoil comprising: an outer wall bounding an interior, the outer wall defining a pressure side and a suction side and extending between a leading edge structure and a trailing edge structure with a trailing edge line, and the outer wall defining a camber line, the trailing edge structure comprising: a linear portion extending from the pressure side toward the trailing edge line; a first curved portion extending between the linear portion and the trailing edge line; and a second curved portion extending between the suction side and the first curved portion.

The airfoil of any preceding clause wherein the first curved portion and the second curved portion meet at a junction, and the first curved portion and the second curved portion are arranged tangent to a common virtual circle defined by a common radius of curvature for the first curved portion and the second curved portion at the junction.

The airfoil of any preceding clause wherein the linear portion is arranged tangent to the pressure side.

The airfoil of any preceding clause wherein the second curved portion is arranged tangent to the suction side.

An airfoil for a turbine engine, the airfoil comprising: an outer wall bounding an interior, the outer wall defining a pressure side and a suction side and extending between a leading edge structure and a trailing edge structure with a trailing edge line, and the outer wall defining a camber line, the trailing edge structure comprising: a linear portion extending from the pressure side toward the trailing edge line; a first curved portion extending between the linear portion and the trailing edge line; and a second curved portion extending between the suction side and the trailing edge line; wherein a virtual diameter can be defined extending between a junction of the linear portion and the first curved portion, and the second curved portion, and wherein the virtual diameter defines a first virtual circle having a first virtual centerpoint; wherein a radius of curvature for the first curved portion and the second curved portion at the trailing edge line defines a second virtual circle having a second virtual centerpoint and a second virtual diameter, and wherein a virtual line can be defined by the first virtual centerpoint and the second virtual centerpoint; wherein a tangent line is defined tangent to the camber line where the virtual line meets the camber line, and wherein an angle can be defined between the tangent line and the virtual line; wherein a ratio of a length of the linear portion to a length of the virtual diameter is between 0.1 and 1.3, a ratio of the virtual diameter to the second virtual diameter is between 0.2 and 1.0, and a ratio of a length of the virtual line to the length of the virtual diameter is between 0.5 and 1.25.

The airfoil of any preceding clause wherein the angle between the tangent line and the virtual line is between 5-degrees and 25-degrees.

The airfoil of any preceding clause wherein the second curved portion is arranged tangent to the suction side.

A method reducing wake losses and shock strength along an airfoil for a gas turbine engine, the airfoil including a pressure side, a suction side, a leading edge line, and a trailing edge line, the method comprising: reducing acceleration of a portion of a fluid along a linear portion of the airfoil, with the linear portion extending at least partially between the pressure side and the trailing edge.

The method of any preceding clause further comprising delaying separation of a second portion of the fluid from the suction side by passing the second portion of the fluid along a second curved portion, arranged between the suction side and the trailing edge and arranged tangent to the suction side.

The method of any preceding clause further comprising reducing vortex generation with a first curved portion provided between the linear portion and the trailing edge, wherein the first curved portion is arranged tangent to both the linear portion and the second curved portion.

A method forming an airfoil for a gas turbine engine, the airfoil including a pressure side, a suction side, a leading edge line, and a trailing edge line, the method comprising: defining a linear portion extending partially between the pressure side and the trailing edge line; defining a first curve extending between the linear portion and the trailing edge line; defining a second curve extending between the trailing edge line and the suction side; and forming the airfoil based upon the defined linear portion, the first curved portion, and the second curved portion.

The method of any preceding clause wherein the first curved portion is tangent to the linear portion.

The method of any preceding clause wherein the first curved portion and the second curved portion are arranged tangent to a second virtual circle.

The method of any preceding clause wherein the second curved portion is tangent to the suction side.

The method of any preceding clause further comprising defining a virtual diameter for a first virtual circle extending from a junction of the linear portion and the pressure side, wherein the virtual diameter is defined perpendicular to a mean camber line.

The method of any preceding clause further comprising defining a second virtual diameter for the second virtual circle.

The method of any preceding clause further comprising defining the position of the second virtual circle, such that an angle can be defined between a virtual line connecting a centerpoint of the first virtual circle to the second virtual circle, and a tangent line defined tangent to the mean camber line where the virtual line intersects the mean camber line.

The method of any preceding clause further comprising defining a first spacing distance and a second spacing distance.

The method of any preceding clause further comprising defining an aft point.

The method of any preceding clause further comprising modelling the airfoil.

The method of any preceding clause further comprising forming the airfoil.

We claim:

1. A gas turbine engine comprising:

a compressor section, a combustion section, and a turbine section in serial flow arrangement; and an airfoil including an outer wall bounding an interior, the outer wall comprising:

a leading edge structure defining a leading edge line;

a trailing edge structure spaced from the leading edge structure and defining a trailing edge line, with a camber line defined between the leading edge line and the trailing edge line;

a pressure side extending between the leading edge structure and the trailing edge structure;

a suction side extending between the leading edge structure and the trailing edge structure;

wherein the trailing edge structure comprises:

a linear portion extending from the pressure side toward the trailing edge line;

a first curved portion extending between the linear portion and the trailing edge line;

a second curved portion extending between the suction side and the trailing edge line; and a virtual diameter defined between the second curved portion and a junction where the pressure side meet the linear portion;

wherein the virtual diameter defines a first virtual circle with a first centerpoint;

wherein a radius of curvature, defined where the first curved portion and the second curved portion meet at the trailing edge line, defines a second virtual circle with a second centerpoint;

wherein a virtual line is defined by the first centerpoint and the second centerpoint;

wherein a tangent line is defined tangent to the camber line and extending from the first centerpoint, with the tangent line arranged at an angle relative to the virtual line; and wherein the linear portion includes a length and a ratio of the length to the virtual diameter is between 0.1 and 1.3.

2. The gas turbine engine of claim 1 wherein the linear portion is arranged tangent to the pressure side.

3. The gas turbine engine of claim 2 wherein the linear portion is arranged tangent to the first curved portion.

4. The gas turbine engine of claim 1 wherein the angle is between 5-degrees and 25-degrees.

5. The gas turbine engine of claim 1 wherein the second virtual circle defines a second virtual diameter, and wherein a ratio of the virtual diameter to the second virtual diameter is between 0.2 and 1.0.

6. The gas turbine engine of claim 1 wherein the virtual line includes a length, and a ratio of the length of the virtual line to a length of the virtual diameter is between 0.5 and 1.25.

7. The gas turbine engine of claim 1 wherein a third junction is defined where the virtual diameter meets the second curved portion, an aft point is defined at an aft-most position of the second curved portion, an axial axis extends axially from the first centerpoint, a first spacing distance is defined as the shortest distance between the aft point and the axial axis, a second spacing distance is defined as the distance between the third junction and where the second curved portion meets the suction side, and wherein a ratio of the first spacing distance to a length of the virtual diameter is between 0.1 and 1.0.

8. The gas turbine engine of claim 7 wherein a ratio of the second spacing distance to the length of the virtual diameter is between 0.1 and 0.65.

9. The gas turbine engine of claim 1 wherein a fourth junction is defined where the linear portion meets the first curved portion, and a distance between the fourth junction and the second centerpoint is greater than or equal to a diameter for the second virtual circle.

10. The gas turbine engine of claim 1 wherein the first curved portion and the second curved portion define a common radius of curvature at the trailing edge line.

11. The gas turbine engine of claim 10 wherein the common radius of curvature defines a second virtual circle, and the first curved portion and the second curved portion are arranged tangent to the second virtual circle at the trailing edge line.

12. The gas turbine engine of claim 1 wherein the second curved portion is arranged tangent to the suction side.

13. An airfoil for a turbine engine, the airfoil comprising:
an outer wall bounding an interior, the outer wall defining a pressure side and a suction side and extending between a leading edge structure and a trailing edge structure with a trailing edge line, and the outer wall defining a camber line, the trailing edge structure comprising:
a linear portion extending from the pressure side toward the trailing edge line;
a first curved portion extending between the linear portion and the trailing edge line; and
a second curved portion extending between the suction side and the trailing edge line;
wherein a virtual diameter can be defined extending between a junction of the linear portion and the first curved portion, and the second curved portion, and wherein the virtual diameter defines a first virtual circle having a first virtual centerpoint;
wherein a radius of curvature for the first curved portion and the second curved portion at the trailing edge line defines a second virtual circle having a second virtual centerpoint and a second virtual diameter, and wherein a virtual line can be defined by the first virtual centerpoint and the second virtual centerpoint;
wherein a tangent line is defined tangent to the camber line where the virtual line meets the camber line, and wherein an angle can be defined between the tangent line and the virtual line; and
wherein a ratio of a length of the linear portion to a length of the virtual diameter is between 0.1 and 1.3.

14. The airfoil of claim 13 wherein the angle between the tangent line and the virtual line is between 5-degrees and 25-degrees.

15. The airfoil of claim 13 wherein a ratio of the virtual diameter to the second virtual diameter is between 0.2 and 1.0.

16. The airfoil of claim 13 wherein a ratio of a length of the virtual line to the length of the virtual diameter is between 0.5 and 1.25.

17. An airfoil for a turbine engine, the airfoil comprising:
an outer wall bounding an interior, the outer wall defining a pressure side and a suction side and extending between a leading edge structure and a trailing edge structure with a trailing edge line, and the outer wall defining a camber line, the trailing edge structure comprising:
a linear portion extending from the pressure side toward the trailing edge line;
a first curved portion extending between the linear portion and the trailing edge line; and
a second curved portion extending between the suction side and the trailing edge line;
wherein a first virtual diameter can be defined extending between a junction of the linear portion and the first curved portion, and the second curved portion, and wherein the first virtual diameter defines a first virtual circle having a first virtual centerpoint;
wherein a radius of curvature for the first curved portion and the second curved portion at the trailing edge line defines a second virtual circle having a second virtual centerpoint and a second virtual diameter, and wherein a virtual line can be defined by the first virtual centerpoint and the second virtual centerpoint;
wherein a tangent line is defined tangent to the camber line where the virtual line meets the camber line, and wherein an angle can be defined between the tangent line and the virtual line; and
wherein, at least one of:
a ratio of a length of the linear portion to a length of the first virtual diameter is between 0.1 and 1.3,
a ratio of the first virtual diameter to the second virtual diameter is between 0.2 and 1.0,
the angle between the tangent line and the virtual line is between 5-degrees and 25-degrees, or
a ratio of a length of the virtual line to a length of the first virtual diameter is between 0.5 and 1.25.

18. The airfoil of claim 17 wherein the airfoil includes the ratio of the first virtual diameter to the second virtual diameter is between 0.2 and 1.0.

19. The airfoil of claim 17 wherein the airfoil includes the angle between the tangent line and the virtual line is between 5-degrees and 25-degrees.

20. The airfoil of claim 17 wherein the airfoil includes the ratio of the length of the virtual line to the length of the first virtual diameter is between 0.5 and 1.25.

* * * * *